United States Patent [19]

Nago et al.

[11] 4,135,136

[45] Jan. 16, 1979

[54] ELECTROMAGNETIC SWITCH MATRIX DEVICE

[75] Inventors: Kazuyoshi Nago; Sadayuki Mitsuhashi; Tetsuo Yoshino, all of Tokyo, Japan

[73] Assignee: Nippon Electric Co., Ltd., Tokyo, Japan

[21] Appl. No.: 805,380

[22] Filed: Jun. 10, 1977

[30] Foreign Application Priority Data

Jun. 11, 1976 [JP] Japan ..... 51-67615

[51] Int. Cl.[2] ..... H01H 67/30

[52] U.S. Cl. ..... 335/112; 335/152

[58] Field of Search ..... 335/112, 152; 340/166 S

[56] References Cited

U.S. PATENT DOCUMENTS 3,953,813 4/1976 Yano et al. ..... 335/112

3,982,216 9/1976 Mitsuhashi et al. ..... 335/112

4,075,433 2/1978 Mitsuhashi et al. ..... 335/152

*Primary Examiner*—Harold Broome

*Attorney, Agent, or Firm*—Rothwell, Mion, Zinn and Macpeak Sughrue

[57] ABSTRACT

An improvement in an electromagnetic switch matrix permits the simultaneous closing of a plurality of cross-points either in the same row or in the same column without causing the erroneous operation of nonselected cross-points. The switch matrix is of the divisionally excited type having a magnetic shunt plate with sealed switches disposed in through apertures therein at cross-point locations. First, second, third and fourth windings are wound around the sealed switches so as to generate control magnetic fields for controlling the operations of the respective sealed switches. An asymmetrical magnetization is given to the sealed switches with respect to the top and bottom planes so that there is a difference in the magnetization of the sealed switches on either side of the shunt plate when driven by the windings.

6 Claims, 17 Drawing Figures

FIG. 1
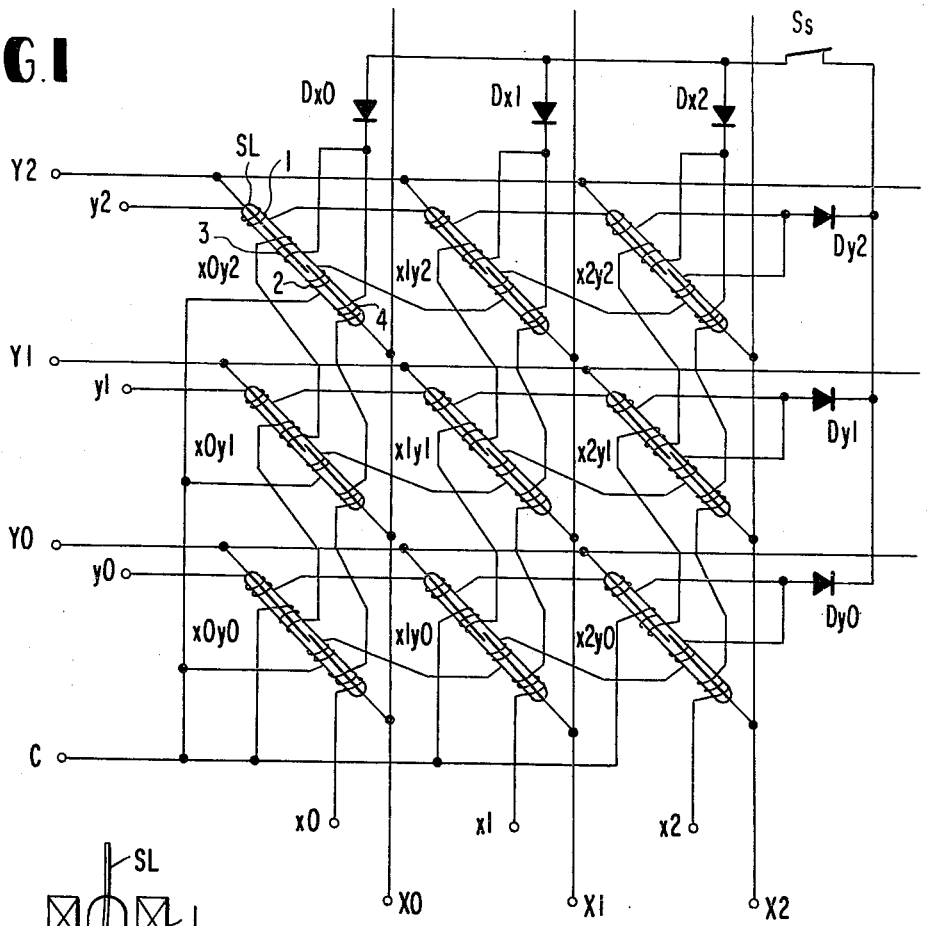
FIG. 2
PRIOR ART
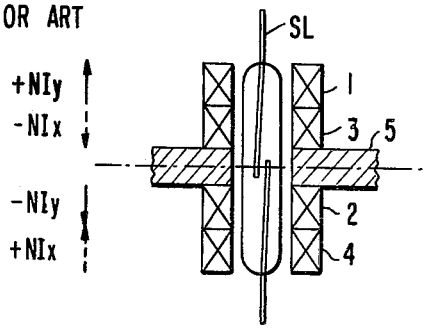
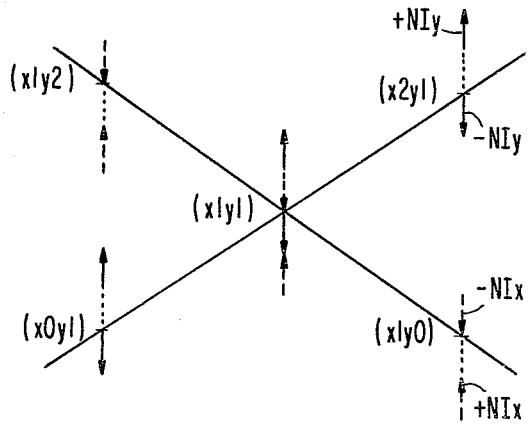
FIG. 3
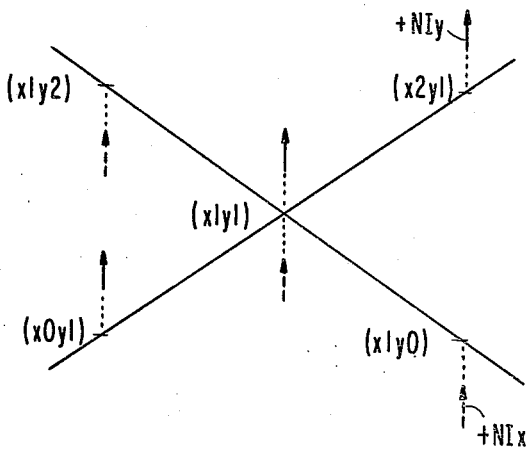
FIG. 4

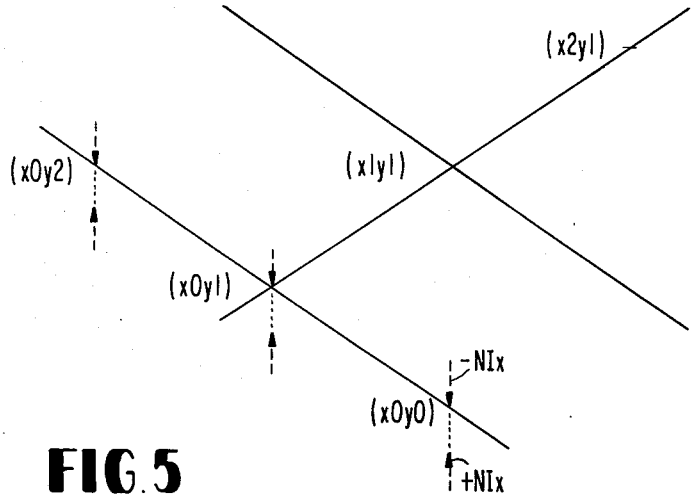
FIG. 5
FIG. 7
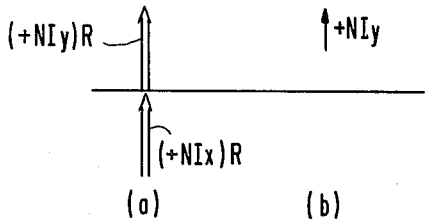
FIG. 6
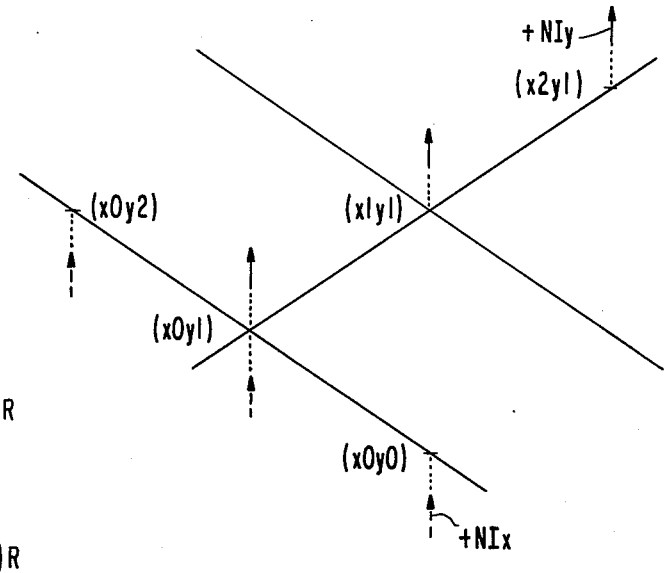
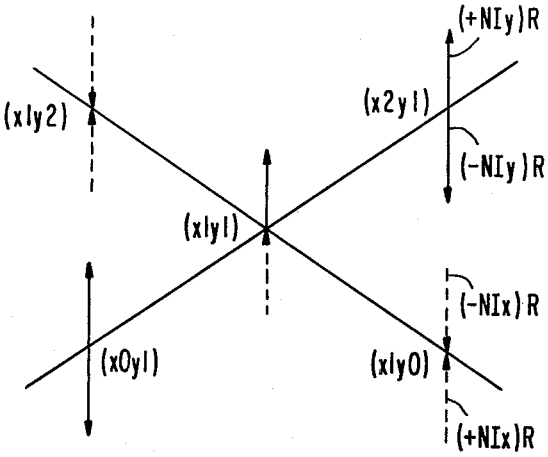
FIG. 8
FIG. 9
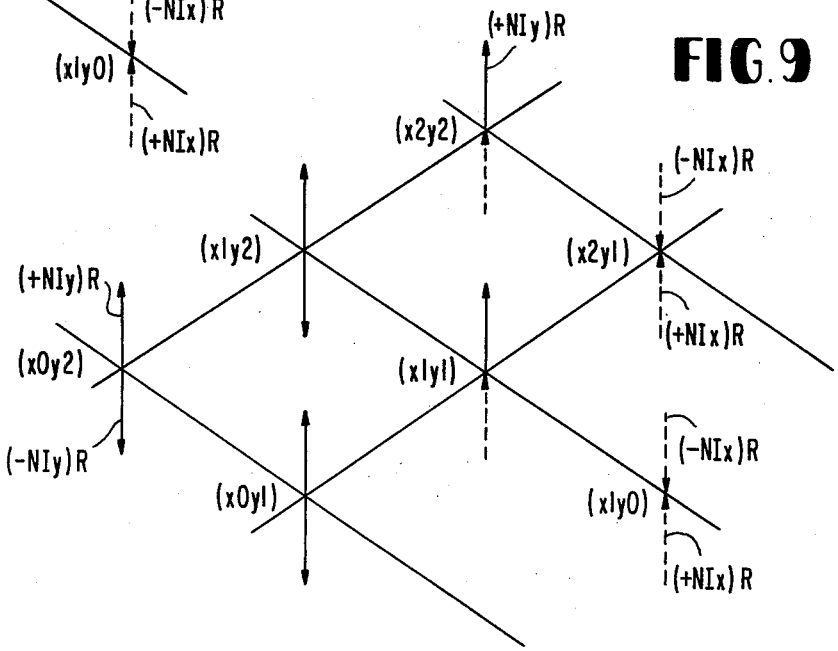

ELECTROMAGNETIC SWITCH MATRIX DEVICE

BACKGROUND OF THE INVENTION

1. Field of the Invention

The present invention relates to an improvement in an electromagnetic switch matrix for automatic exchanges, hybrid computers and the like, in which magnetically responsive switch elements are penetrated through a magnetic shunt plate and provided with excitation coils at cross-points where row signal lines and column signal lines intersect at right angles to each other.

2. Description of the Prior Art

In a switch matrix employing sealed switches, a reversed-magnetization no-current holding type switch element called "Ferreed switch" has been used.

In such Ferreed switches, a desired number of sealed switches are inserted between two "remainders", planar magnetic cores made of semi-hard magnetic material. At the center of these planar magnetic cores is disposed a magnetic shunt plate forming a magnetic shunt path. Above and below the magnetic shunt plate are respectively disposed two sets of windings, each set consisting of windings of N and 2N in the number of turns, respectively, so as to effect the differential excitation.

The operation of the Ferreed switch is such that when a driving current is fed to both the two sets of the windings, the magnetization of the planar magnetic core is in the same direction at a point above and below the magnetic shunt plate thereby to close the sealed switch. When the driving current is fed to only one set of the windings, the magnetization is in opposite directions at a point above and below the magnetic shunt plate, so that the sealed switch is opened due to elasticity of the contact springs.

In the Ferreed switch matrix, a desired number of Ferreed switches are disposed in matrix form, one of the two sets of the windings are connected in common in the row direction, while the other set of windings are connected in common in the column direction to constitute the switch matrix.

However, in such a switch matrix, since driving currents are fed simultaneously to the windings connected in common along a row and to the windings connected in common along a column, the sealed switches located at the cross-points in rows and columns associated with a particular cross-point are all magnetized in the opposite directions at a point above and below the magnetic shunt plate, and are thereby opened. Accordingly the sealed switches at a plurality of cross-points in the same row or in the same column cannot be simultaneously closed.

An electromagnetic switch matrix designed to overcome this difficulty is proposed in the U.S. Pat. No. 3,953,813 issued to Yano et al. and U.S. Pat. No. 3,982,216 issued to Mitsuhashi et al.

These conventional electromagnetic switch matrices of divisional excitation type comprise a desired number of sealed switches having self-holding capabilities and arrayed in a matrix form, a magnetic shunt plate for forming magnetic shunt paths disposed at the center portions of the contacts in these sealed switches, first and second winding means for controlling said sealed switches aligned along a column between said magnetic shunt plate and said first winding means and on said the other side of said magnetic shunt plate outside of said second winding means, respectively, and means for short-circuiting said second and third winding means in a selected row and a selected column, respectively, when required, said first to fourth winding means having substantially the same number of turns, a magnetic circuit on one side of said magnetic shunt plate and a magnetic circuit on the other side of said magnetic shunt plate being constructed in a magnetically symmetrical form, and said first to fourth winding means are connected in such polarities that magnetic fields generated by said first and fourth winding means are directed in one direction while magnetic fields generated by second and third winding means are directed in the other direction.

In such a switch matrix, when a sealed switch at a particular cross-point is to be closed, a first driving current is fed to all the first to fourth winding means pertinent to that particular cross-point to open the sealed switches at the associated cross-points (the other cross-points in the same row and in the same column as the particular cross-point) by magnetizing the sealed switches in the opposite directions to each other on the respective sides of the magnetic shunt plate with the first and third winding means or the second and fourth winding means, then the second and third winding means are short-circuuited with said means for short-circuiting the second and third winding means to feed a second driving current only to the first and fourth winding means, thereby to close the sealed switch at the particular cross-point.

In such a switch matrix, it is possible to effect the simultaneous closing of switches at a plurality of cross-points in the same row or in the same column, because the separate driving currents are fed for opening and closing, respectively, of the cross-point switch. However, in this type of switch matrix, the direction of remanent magnetization at the associated cross-points that is determined by the first driving current needs to coincide with the direction of the excitation magnetic field applied to the associated cross-points by the second driving current, and if these magnetic fields do not coincide with each other, the associated cross-point switches tend to operate erroneously.

Thus, the particular cross-point selectively closed first and another cross-point not associated with the particular cross-point (a cross-point other than the cross-points either in the same row or in the same column as the particular cross-point) is then selectively closed. Under this state, another cross-point in the same row as the particular cross-point is selectively closed for double connection, with the direction of remanent magnetization and the direction of the excitation magnetic field generated by the second driving current at the associated cross-points being different from each other. This makes it necessary to effect the double connection such that immediately after the particular cross-point has been selectively closed, another cross-point in the same row as the particular cross-point should be selectively closed.

SUMMARY OF THE INVENTION

It is one object of the present invention to provide an improved switch matrix of divisional excitation type, which can arbitrarily effect the simultaneously closing of a plurality of cross-points either in the same row or in the same column without being restricted by the condition for selecting operations and regardless of the direction of remanent magnetization at the associated cross-points.

Accordingly to one feature of the present invention, there is provided a divisional excitation type switch matrix, in which sealed switches are disposed at cross-points where a plurality of row signal lines arranged in a direction of rows and a plurality of column signal lines arranged in a direction of columns interect substantially at right angles to each other, and there are provided control lines for said sealed switches consisting of row control lines and column control lines corresponding to said row and column signal lines, respectively, characterized in that said sealed switches have self-holding capabilities, that said sealed switches are provided with actuating means therefor including a magnetic shunt plate for forming magnetic shunt paths for said respective sealed switches, first and second winding means connected to a row control line for controlling said sealed switches aligned along a row on one side and on the other side, respectively, of said magnetic shunt plate, and third and fourth winding means connected to a column control line for controlling said sealed switches aligned along a column between said magnetic shunt plate and said first winding means and on the other side of said magnetic shunt plate outside of said second winding means, respectively, said first to fourth winding means being connected in such polarities that magnetic fields generated by said first and fourth winding means are directed in one direction while magnetic fields generated by said second and third winding means are directed in the other direction, and that a magnetic circuit on one side of said magnetic shunt plate acting upon said sealed switches and a magnetic circuit on the other side are constracted in a magnetically asymmetrical form.

BRIEF DESCRIPTION OF THE DRAWINGS

FIG. 1 is a wiring diagram of a signal section and a control section of an electromagnetic switch matrix to which the present invention is applicable, FIG. 2 is a cross-sectional view showing a structure of a cross-point element in a divisional excitation type switch matrix in the prior art, FIG. 3 is a diagramatic view showing the excited state of the respective switches when the switches either in the same row or in the same column as a particular switch are opened, FIG. 4 is a diagramatic view showing the excited state of the respective switches when the particular switch is closed, FIG. 5 is a diagramatic view showing the excited state of the respective switches for the case where the double connection is to be made for another switch in the same row as the particular switch.

FIG. 6 is a diagramatic view showing the excited state of the respective switches when the double connection has been made, FIG. 7 is a diagramatic view showing the magnetization state of the particular switch, FIG. 8 is a diagramatic view showing the magnetization state of the respective switches when the particular switch has been selectively closed, FIG. 9 is a diagramatic view showing the magnetization state of the respective switches for the case where after a particular switch was closed another particular switch pertinent to a different row and a different column has been selectively closed.

DETAILED DESCRIPTION OF THE INVENTION

Figure 10:
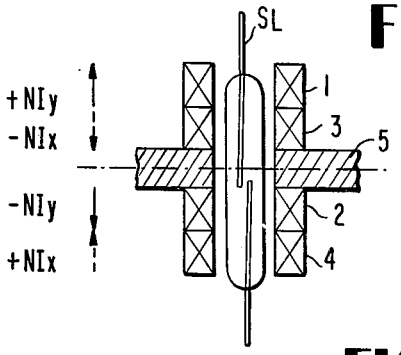
FIG. 10 is a schematic cross-sectional view showing a structure of a cross-point element according to a first preferred embodiment of the present invention.

Referring to FIG. 1 showing a switch matrix, reference characters X and Y represent signals lines, while reference symbols x and y represent control lines. In the embodiment, in correspondence to row signal lines $Y_0$, $Y_1$ and $Y_2$ are provided row control lines $y_0$, $y_1$ and $y_2$, and in correspondence to column signal lines $X_0$, $X_1$ and $X_2$ are provided column control lines $x_0$, $x_1$ and $x_2$. In addition, at the respective cross-points where the row signal lines $Y_0$, $Y_1$ and $Y_2$ intersect with the column signal lines $X_0$, $X_1$, and $X_2$ are interposed sealed switches $S_L$ made of semi-hard magnetic material and having a self-holding capability so as to bridge the respective row signal lines and the respective column signal lines.

These sealed switches $S_L$ are excited by first and second windings 1 and 2 which are connected in common to the respective row control lines $y_0$, $y_1$ and $y_2$ corresponding to the rows to which they are pertinent, and by third and fourth windings 3 and 4 which are connected in common to the respective column control lines $x_0$, $x_1$ and $x_2$ corresponding to the columns to which they are pertinent. Here it is to be noted that the first and fourth windings 1 and 4 are connected so as to generate magnetic fields directed in the same direction, whereas the second and third windings 2 and 3 are connected so as to generate magnetic fields directed in the opposite direction to the magnetic fields generated by the windings 1 and 4. In addition, to the junction between the windings 1 and the windings 2 are connected a group of diodes $D_{y0}$–$D_{y2}$ in selected polarities, and to the junctions between the windings 3 and 4 are also connected another group of diodes $D_{y0}$–$D_{x2}$ in selected polarities. Furthermore, the diode groups $D_{y0}$ to $D_{y2}$ and $D_{y0}$ to $D_{x2}$ are connected to each other via a short-circuiting switch $S_s$ for short-circuiting the windings 2 and 3. Also, the junctions between the windings 2 and 3 are connected to a common control line C.

Referring to FIG. 2 showing in cross-section the structure of a cross-point element in a conventional divisional excitation type switch matrix, a contact gap clearance portion of a sealed switch $S_L$ made of semi-hard magnetic material and having a self-holding capability is disposed at the center of a magnetic shunt plate 5. On the upper side of the magnetic shunt plate 5 are wound a third winding 3 and a first winding 1 around the sealed switch $S_L$ and stacked vertically, while on the lower side of the magnetic shunt plate 5 are wound a second winding 2 and a fourth winding 4 around the switch $S_L$ and stacked vertically. Since these first to fourth windings 1 to 4 have substantially the same number of turns, magnetic circuits acting upon the sealed switch are constructed in a symmetrical form on the opposite sides of the magnetic shunt plate 5.

Referring to FIG. 3 showing the excited state of the respective cross-point elements, a first driving current is fed to the divisional excitation type switch matrix formed by employing the cross-point elements of FIG. 2 arranged as shown in FIG. 1 with the short-circuiting switch $S_s$ opened, to open the cross-point elements either in the same row or in the same column as the particular cross-point. For instance, if a first driving current is fed to the row control line $y_1$ and the column control line $x_1$ in the circuit of FIG. 1, then the sealed switches at the cross-points in the same row as the cross-point $x_1$ $y_1$ are excited in the mutually opposite directions by a magnetic field $+NI_y$ generated by the winding 1 and a magnetic field $-NI_y$ generated by the winding 2. Also, the sealed switches at the cross-points in the same column as the cross-point $x_1$ $y_1$ are excited in the mutually opposite directions by a magnetic field $-NI_x$ generated by the winding 3 and a magnetic field $+NI_x$ generated by the winding 4, thereby to open these sealed switches.

Referring to FIG. 4 diagramatically showing the excited state of the respective cross-point elements for the case where the second driving current is fed to the switch matrix by closing the short-circuiting switch $S_s$ to selectively close the particular cross-point element, if the driving current is fed to the row control line $y_1$ and the column control line $x_1$ then the sealed switch at the cross-point $x_1$ $y_1$ is additively magnetized by the magnetic field $+NI_y$ generated by the winding 1 and the magnetic field $+NI_x$ generated by the winding 4, thereby closing the sealed switch.

Now, to describe the selective closing of an additional cross-point element in the same row, it is assumed that cross-point $x_0$ $y_1$, is to be closed in addition to the already closed cross-point $x_1$ $y_1$. A first driving current is caused to flow through the common control line C and the column control line $x_0$ as shown in FIG. 1 to excite the sealed switches on the column $x_0$ in mutually opposite directions by the magnetic fields-$NI_x$ and $+NI_x$ as shown in FIG. 5 to open all these sealed switches. Subsequently, a second driving current is fed through the row control line $y_1$ and the column control line $x_0$ by closing the short-circuiting switch $S_s$, additively magnetizing the sealed switch located at the cross-point $x_0$ $y_1$ by the magnetic fields $+NI_y$ and $+NI_x$ as shown in FIG. 6, thereby closing the sealed switch. It is to be noted that the state of remanent magnetization of the sealed switch at the cross-point $x_1$ $y_1$ that has been already closed, is the state comprising remanent magnetization $(+NI_y)_R$ caused by the winding 1 and remanent magnetization $(+NI_x)_R$ caused by the winding 4 as shown at (a) in FIG. 7, so that even if the magnetic field $+NI_y$ is applied to the same sealed switch, no change occurs in the remanent magnetization, realizing the double connection at the cross-points $x_1$ $y_1$ and $x_0$ $y_1$.

As described above, when the double connection is made at the cross-point $x_0$ $y_1$ in addition to the cross-point $x_1$ $y_1$ immediately after the cross-point $x_1$ $y_1$ has been selectively closed, no change occurs in the state of remanent magnetization, maintaining the other cross-points in the open state.

However, in the case of the following selecting condition, erroneous operations may occur. More definite description will now be given hereunder. The state of the remanent magnetization at the respective cross-points for the selectively closed cross-point $x_1$ $y_1$ is as shown in FIG. 8. Under this state, if another cross-point that is pertinent neither to the row nor to the column of the cross-point $x_1$ $y_1$, for example, the cross-point $x_2$ $y_2$ is assumed to be selected and closed through the same process as that described above with reference to FIGS. 3 and 4, then the state of the remanent magnetization at the respective cross-points is as shown in FIG. 9. The state of the remanent magnetization at the cross-point $x_2$ $y_1$, for example and at the time shown in FIG. 8, is such that mutually opposed magnetizations due to the remanent magnetization $(+NI_y)_R$ and $(-NI_y)_R$ caused respectively by the windings 1 and 2 are observed. That state is changed to another state of mutually opposed magnetization comprising the remanent magnetizations $(-NI_x)_R$ and $(+NI_x)_R$ caused respectively by the windings 3 and 4. Subsequently, if double connection is to be made at the cross-point $x_0$ $y_1$ in addition to the cross-point $x_1$ $y_1$ through the same process as described above with reference to FIGS. 5 and 6, the magnetic field $+NI_y$ is applied at the cross-point $x_2$ $y_1$ which is in the state of remanent magnetization as shown in FIG. 9. The remanent magnetization $(-NI_x)_R$ of the sealed switch is therefore reversed, causing the erroneous closing at the cross-point $x_2$ $y_1$.

Referring to FIG. 10 showing a first preferred embodiment of the present invention, the contact gap clearance portion of the sealed switch $S_L$ made of semi-hard magnetic material and having the self-holding capability is positioned under the center plane of the magnetic shunt plate 5. On the upper side of the magnetic shunt plate 5 are wound the third winding 3 and the first winding 1 around the sealed switch $S_L$ and stacked vertically, while on the lower side of the magnetic shunt plate 5 are wound the second winding 2 and the fourth winding 4 around the sealed switch $S_L$ as piled up vertically. The number of turns of the windings 1, 2, 3 and 4 are substantially the same. The magnetic circuit designed for exciting the sealed switch is constructed in an asymmetrical form with respect to the magnetic shunt plate 5 so that on the upper side of the magnetic shunt plate 5 the magnetic resistance between the winding 1 and the contact gap clearance portion of the sealed switch $S_L$ may become larger than that on the lower side of the magnetic shunt plate 5, i.e. the resistance between the winding 4 and the contact gap clearance portion of the sealed switch $S_L$.

Figure 11:
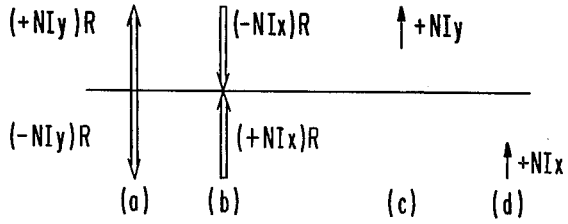
FIG. 11 is a diagramatic view for explaining the relation between the state of remanent magnetization of the associated cross-point switches and the magnetic fields generated by the driving current when double connection is made in a switch matrix employing cross-point elements having the novel structure shown in FIG. 10.

Refering to FIG. 11 showing the relation between the state of the remanent magnetization of the associated cross-point switches and the magnetic fields generated by the driving current when double connection is made in the switch matrix employing cross-point switches of FIG. 10, the cross-point switch is magnetized in the mutually opposite directions at the cross-points in the same column as the cross-point $x_0$ $y_1$ at the cross-points $x_0$ $y_0$ and $x_0$ $y_2$, for example due to the remanent magnetizations $(-NI_x)_R$ and $(+NI_x)_R$ caused by the windings 3 and 4. This results in the opening of the cross-point switch. Therefore, the state of the remanent magnetization is not changed by the magnetic field $+NI_x$ even under the double connection state as shown at (d) in FIG. 11 keeping the cross-points $x_0$ $y_0$ and $x_0$ $y_2$ in the open state. In addition, the sealed switches at the cross-points in the same row as the cross-points $x_0$ $y_1$ and $x_1$ $y_1$, or at the cross-point $x_2$ $y_1$, for instance, are magnetized in either one state of remanent magnetization of those shown at (a) and (b) in FIG. 11, and are thereby opened.

When the sealed switch is opened by the mutually opposite magnetization due to the remanent magnetizations $(+NI_y)_R$ and $(-NI_y)_R$ caused by the windings 1 and 2 as shown at (a) in FIG. 11, the state of remanent magnetization of the sealed switch is not changed by the magnetic field $+NI_y$ even when the second driving current as shown at (c) in FIG. 11 is fed. Accordingly, the sealed switch at the cross-point $x_2$ $y_1$ is kept open. When the magnetic field $+NI_y$ is applied by the winding 1 in response to the second driving current (FIG. 11(*c*)) under the state where the switch is in the open state due to the remanent fields $(-NI_x)_R$ and $(+NI_x)_R$ caused by windings 2 and 4 (FIG. 11(*b*)), the field $+NI_y$ generated by the winding 1 does not have any magnetic effect on the clearance gap of the sealed switch contacts, because the winding 1 is off-set with respect to the gap or to the middle of the magnetic shunt plate 5. Thus, the sealed switch at the cross point $x_2$ $y_1$ remains in open state.

Figure 12:
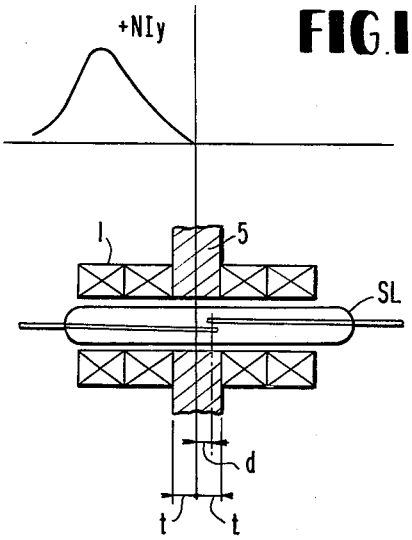
FIG. 12 is a diagram of magnetic field distribution applied to the other switches in the same row as the particular switch except for the particular switch as well as the double-connection switch upon effecting double connection, and FIGS. 13, 14, 15, 16 and 17, respectively, are cross-sectional views showing a structures of cross-point switches according to other preferred embodiments of the present invention.

Since the respective windings and the sealed switch are off-set with respect to the shunt plate 5, the driving current margin for the simultaneous closing of sealed switches at a plurality of cross-points in the same row becomes large, so that the operation stability is enhanced. More definitely, it is assumed in FIG. 12 that the thickness of the magnetic shunt plate 5 is denoted by $2t$ and the shift of the contact gap from the imaginary center plane of the magnetic shunt plate 5 by d, then in contrast to the fast that (in the case where the contact gap clearance portion of the sealed switch is disposed on the center plane of the magnetic shunt plate 5) the driving current margin for the double connection is 1.3 times for $d/t=0$, it can be improved up to 1.6 times for $d/t=0.25$ and 1.9 times for $d/t=0.5$.

Figure 13:
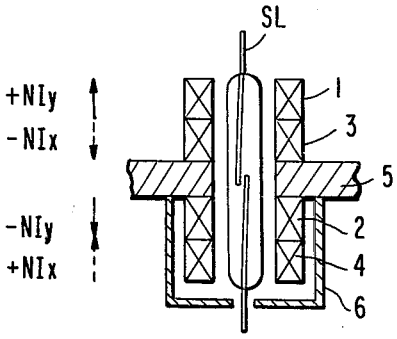

Referring to FIG. 13 showing a second preferred embodiment, the contact gap clearance portion of the sealed switch $S_L$ is disposed on the center plane of the magnetic shunt plate 5. Above and below the plate 5 are wound windings 1 and 4, respectively, around the sealed switch and stacked vertically on windings 2 and 3, respectively. These windings have substantially the same number of turns. Under the magnetic shunt plate 5 is disposed a magnetic yoke 6. Owing to this magnetic yoke 6, the magnetic resistance between the winding 4 on the lower side of the magnetic shunt plate 5 and the sealed switch is smaller than the magnetic resistance between the winding 1 on the upper side of the magnetic shunt plate 5 and the sealed switch. Thus, the magnetic circuit is constructed asymmetrically with respect to the plate 5.

Figure 14:
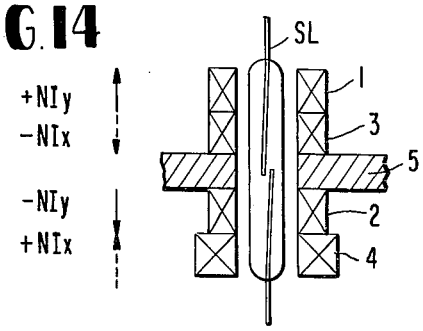

Referring to FIG. 14 showing a third embodiment, the contact gap clearance portion of the sealed switch $S_L$ is disposed at the center plane of the magnetic shunt plate 5. On the upper side of the magnetic shunt plate 5 are wound the windings 3 and 1 around the sealed switch and stacked vertically, while on the lower side of the magnetic shunt plate 5 are wound windings 2 and 4 around the sealed switch and stacked vertically. Winding 4 has a larger number of turns than winding 1. Accordingly, the magnetic field $+NI_x$ generated by the winding 4 is stronger than the magnetic field $+NI_y$ generated by the winding 1. An asymmetrical magnetic circuit is therefore provided with respect to the plate 5 as in the case of FIG. 13.

Figure 15:
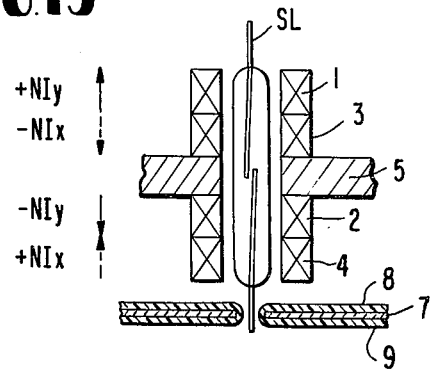

Referring to FIG. 15, showing a fourth preferred embodiment, a printed circuit board is employed, which is prepared by subjecting a core plate 7 made of soft magnetic material to insulating treatment with resin 8 such as epoxy, Teflon (registered trademark of du Pont for tetrafluorethylene), etc. and depositing on its surface a printed pattern forming row or column signal lines. The board 9 is disposed under the magnetic shunt plate 5 in place of the magnetic yoke 6. By soldering the sealed switch $S_L$ to this printed wiring board 9, the switch $S_L$ can be firmly fixed. In this embodiment also, the core plate 7 of the printed circuit board 9 forms a magnetic yoke, so that the magnetic resistance between the winding 4 on the lower side of the magnetic shunt plate 5 and the sealed switch is smaller than the magnetic resistance between the winding 1 on the upper side of the magnetic shunt plate 5 and the sealed switch. This results in an asymmetrical magnetic circuit as in the case of the above embodiments.

Figure 16:
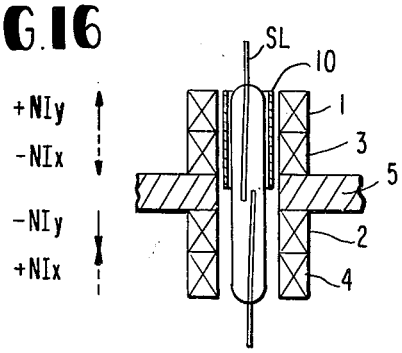

Referring to FIG. 16 showing a fifth preferred embodiment, the positioning of the windings and the sealed switch is identical to the embodiments of FIGS. 13 and 15. On the upper side of the magnetic shunt plate 5, however, a cylinder 10 made of soft magnetic material is mounted inside of the windings 1 and 3. In this embodiment, since the magnetic field $+NI_y$ generated by the winding 1 is shielded by the cylinder 10 and does not substantially magnetize the sealed switch $S_L$ until the cylinder 10 is magnetically saturated, an asymmetrical magnetic circuit results as in the case of other embodiments.

Figure 17:
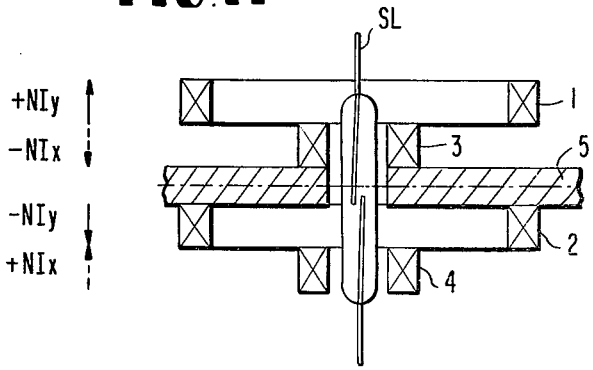

Referring to FIG. 17 showing a sixth preferred embodiment, a contact portion of the sealed switch $S_L$ is off-set with respect to the magnetic shunt plate 5, with windings 1 and 2 of substantially the same number of turns wound in common around all the sealed switches in the same row, and with windings 3 and 4 wound in common around all the sealed switches in the same column. In this embodiment also, the off-set of the switches results in an asymmetrical magnetic circuit with respect to the magnetic shunt plate 5.

It is a matter of course that the above-described first to sixth embodiments could be practiced in combination. In addition, while the preferred embodiments have been explained in conjunction with the single-wire system of the switch matrix, the invention is equally applicable to two-wire or four-wire systems.

As described above, the divisional excitation type switch matrix according to the present invention has an advantage that even when the switches simultaneously close at a plurality of cross-points in the same row or in the same column, the driving current margin is large to enhance the operating stability, owing to the facts that the sealed switches at the other cross-points in the same row or in the same column are excited by the windings disposed at the positions remote from the control gap clearance portions of the sealed switches, and that the asymmetrical magnetic circuit with respect to the imaginary center plane the magnetic shunt plate is employed to reduce the magnetic effect of the excitation caused by these remote windings upon the contact clearance portions of the sealed switches.

Furthermore, the first to fourth windings need not be individually wound around the respective sealed switches as shown in FIGS. 10 and 13 to 16, or serially connected as shown in FIG. 1, in common to all the sealed switches pertinent to the same row or to the same column as shown in FIG. 17. Even combined individual and common windings may be employed. Therefore, the terms "first winding means", "second winding means", "third winding means" and "fourth winding means" as used herein should be interpreted to mean both the series connection of individually wound excitation windings and the commonly wound excitation winding corresponding to each row or each column.

Since many other changes can be made in the above embodiments and modifications without departing from the scope thereof, it is intended that all the matter contained in the above description or shown in the accompanying drawings should be interpreted as illustrative and not as a limitation to the scope of the invention.

What is claimed is:

1. In a electromagnetic switch matrix device of the divisionally excited type comprising:

a plurality of elongated sealed switching means each with two ends, having a magnetic self-holding action such that said switching means conducts only when both ends are in magnetic fields having the same orientation;

a magnetic shunt plate having a top and a bottom with through apertures therebetween, said apertures arranged in rows and columns such that the apertures are located at the cross-points of said rows and columns to allow said switching means to be inserted therein; and first, second, third and fourth windings wound round said switching means so as to generate control magnetic fields for controlling the operations of the respective switching means, said first and third windings being placed on said top side of said magnetic shunt plate and said second and fourth windings being placed on said bottom side of said magnetic shunt plate, said first and second windings being arranged for controlling said switching means in a row and said third and fourth windings being arranged for controlling said switching means in a column, wherein the improvement comprises:

a magnetic asymmetry means for giving asymmetrical magnetization to said switching means with respect to the top and bottom plane of said magnetic shunt plate so that the top-side end and the bottomside end of said switching means may have a difference in magnetization when driven by said windings.

2. In a electromagnetic switch matrix device of the divisionally excited type comprising:

a plurality of elongated sealed switching means each with two ends, having a self-holding action such that said switching means conducts only when both ends are in magnetic fields having the same orientation;

a magnetic shunt plate having a top and a bottom with through apertures therebetween, said apertures arranged in rows and columns such that the apertures are located at the cross-points of said rows and columns to allow said switching means to be inserted therein; and first, second, third and fourth windings wound around said switching means so as to generate control magnetic fields for controlling the operations of the respective switching means, said first and third windings being placed on said top side of said magnetic shunt plate and said second and fourth windings being placed on said bottom side of magnetic shunt plate, said first and second windings being arranged for controlling said switching means in a row and said third and fourth windings being arranged for controlling said switching means in a column, wherein the improvement comprises:

a magnetic asymmetry means for giving asymmetrical magnetization to said switching means with respect to the top and bottom plane of said magnetic shunt plate so that the top-side end and the bottom-side end of said switching means may have a difference in magnetization when driven by said windings, said magnetic asymmetry means comprising means for holding said switch means in an offset state with respect to the plane of said magnetic shunt plate so that the contact gap clearance portion of said switching means may be maintained in said off-set state.

3. In a electromagnetic switch matrix device of the divisionally excited type comprising:

a plurality of elongated sealed switching means each with two ends, having a magnetic self-holding action such that said switching means conducts only when both ends are in magnetic fields having the same orientation;

a magnetic shunt plate having a top and a bottom with through apertures therebetween, said apertures arranged in rows and columns such that the apertures are located at the cross-points of said rows and columns to allow said switching means to be inserted therein; and first, second, third and fourth windings wound around said switching means so as to generate control magnetic fields for controlling the operations of the respective switching means, said first and third windings being placed on said top side of said magnetic shunt plate and said second and fourth windings being placed on said bottom side of said magnetic shunt plate, said first and second windings being arranged for controlling said switching means in a row and said third and fourth windings being arranged for controlling said switching means in a column, wherein the improvement comprises:

a magnetic asymmetry means for giving asymmetrical magnetization to said switching means with respect to the top and bottom plane of said magnetic shunt plate so that the topside and the bottomside end of said switching means may have a difference in magnetization when driven by said windings, said magnetic asymmetry means comprising a magnetic yoke disposed on one of said top and bottom sides of said magnetic shunt plate.

4. In a electromagnetic switch matrix device of the divisionally excited type comprising:

a plurality of elongated sealed switching means each with two ends, having a magnetic self-holding action such that said switching means conducts only when both are in magnetic fields having the same orientation;

a magnetic shunt plate having a top and a bottom with through apertures therebetween, said apertures arranged in rows and columns such that the apertures are located at the cross-points of said rows and columns to allow said switching means to be inserted therein; and first, second, third and fourth windings wound around said switching means so as to generate control magnetic fields for controlling the operations of the respective switching means, said first and third windings being placed on said top side of said magnetic shunt plate and said second and fourth windings being placed on said bottom side of said magnetic shunt plate, said first and second windings being arranged for controlling said switching means in a row and said third and fourth windings being arranged for controlling said switching means in a column, wherein the improvement comprises:

a magnetic asymmetry means for giving asymmetrical magnetization to said switching means with respct to the top and bottom plane of said magnetic shunt plate so that the top-side end and the bottom-side end of said switching means may have a difference in magnetization when driven by said windings, said magnetic asymmetry means comprising said fourth winding having a large number of turns than said first winding.

5. In a electromagnetic switch matrix device of the divisionally excited type comprising:

a plurality of elongated sealed switching means each with two ends, having a magnetic self-holding action such that said switching means conducts only when both ends are in magnetic fields having the same orientation;

a magnetic shunt plate having a top and a bottom through apertures therebetween, said apertures arranged in rows and columns such that the apertures are located at the cross-points of said rows and columns to allow said switching means to be inserted therein; and first, second, third and fourth windings wound around said switching means so as to generate control magnetic fields for controlling the operations of the respective switching means, said first and third windings being placed on said top side of said magnetic shunt plate and said second and fourth windings being placed on said bottom side of said magnetic shunt plate, said first and second windings being arranged for controlling said switching means in a row and said third and fourth windings being arranged for controlling said switching means in a column, wherein the improvement comprises:

a magnetic asymmetry means for giving asymmetrical magnetization to said switching means with respct to the top and bottom plane of said magnetic shunt plate so that the top-side end and the bottom-side end of said switching means may have a difference in magnetization when driven by said windings, said magnetic asymmetry means comprising a printed circuit board made of resin-coated soft magnetic material disposed on one of the top and bottom sides of said magnetic shunt plate.

6. In a electromagnetic switch matrix device of the divisionally excited type comprising:

a plurality of elongated sealed switching means each with two ends, having a magnetic self-holding action such that said switching means conducts only when both ends are in magnetic fields having the same orientation;

a magnetic shunt plate having a top and a bottom with through apertures therebetween, said apertures arranged in rows and columns such that the apertures are located at the cross-points of said rows and columns to allow said switching means to be inserted therein; and first, second, third and fourth windings wound around said switching means so as to generate control magnetic fields for controlling the operations of the respective switching means, said first and third windings being placed on said top side of said magnetic shunt plate and said second and fourth windings being placed on said bottom side of said magnetic shunt plate, said first and second windings being arranged for controlling said switching means in a row and said third and fourth windings being arranged for controlling said switching means in a column, wherein the improvement comprises:

a magnetic asymmetry means for giving asymmetrical magnetization to said switching means with respect to the top and bottom plane of said magnetic shunt plate so that the top-side end and the bottom-side end of said switching means may have a difference in magnetization when driven by said windings, said magnetic asymmetry means comprising cylinder made of soft magnetic material mounted inside of said first and third windings.

* * * * *

UNITED STATES PATENT AND TRADEMARK OFFICE

CERTIFICATE OF CORRECTION

PATENT NO. : 4,135,136

DATED : January 16, 1979

INVENTOR(S) : Kazuyoshi NAGO et al

It is certified that error appears in the above-identified patent and that said Letters Patent are hereby corrected as shown below:

IN THE SPECIFICATION:

Column 2, line 25 - delete "short-circuuited" insert -- short-circuited --

Column 3, line 6 - delete "interect" insert -- intersect -- line 32 - delete "constracted" insert -- constructed -- line 52 - after "switch" delete "." insert -- , --

Column 4, line 13 - after "showing" delete "a"

line 20 - delete "signals" insert -- signal -- line 50 - delete "$D_{y0}$" insert -- $D_{x0}$ -- line 52 - delete "$D_{y0}$" insert -- $D_{x0}$ --

Column 6, line 37 - after "$S_L$" delete "as"

UNITED STATES PATENT AND TRADEMARK OFFICE

CERTIFICATE OF CORRECTION

PATENT NO. : 4,135,136

DATED : January 16, 1979

INVENTOR(S) : Kazuyoshi NAGO et al

It is certified that error appears in the above-identified patent and that said Letters Patent are hereby corrected as shown below:

IN THE SPECIFICATION:

Column 6, line 38 - delete "piled up" insert -- and stacked --

IN THE CLAIMS:

Column 11, line 11 - delete "large" insert -- larger -- line 20 - after "bottom" insert -- with --

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*